United States Patent [19]

Braillon

[11] Patent Number: 4,465,993

[45] Date of Patent: Aug. 14, 1984

[54] MAGNETIC HOLDER

[75] Inventor: Philibert M. Braillon, Montmelian, France

[73] Assignee: Braillon & Cie, Montmelian, France

[21] Appl. No.: 478,078

[22] Filed: Mar. 23, 1983

[30] Foreign Application Priority Data

Mar. 25, 1982 [FR] France ..... 82 05681

[51] Int. Cl.[3] ..... H01F 7/20

[52] U.S. Cl. ..... 335/287; 335/295

[58] Field of Search ..... 335/285, 286, 287, 295

[56] References Cited

U.S. PATENT DOCUMENTS

| | | | |
|---|---|---|---|
| 3,184,654 | 5/1965 | Bey | 335/295 |
| 3,452,310 | 6/1969 | Israelson | 335/295 X |
| 4,055,824 | 10/1977 | Baermann | 335/288 |
| 4,122,922 | 10/1978 | Baermann | 335/306 X |

*Primary Examiner*—George Harris

*Attorney, Agent, or Firm*—Karl F. Ross; Herbert Dubno

[57] ABSTRACT

A magnetic holder has a permanent magnet stator and a permanent magnet rotor, the magnetic mass of the latter being greater than that of the form and a play defining an air gap being provided between them so that the losses in the air gap compensate for the magnetic mass by which the rotor permanent magnet exceeds the stator permanent magnet.

10 Claims, 6 Drawing Figures

MAGNETIC HOLDER

CROSS REFERENCE TO RELATED APPLICATION

This application is related to my copending application Ser. No. 181,085 filed 22 August 1980 (now U.S. Pat. No. 4,379,277) and reference may also be had to U.S. Pat. Nos. 3,775,717 and 4,075,589 on related subject matter.

FIELD OF THE INVENTION

My present invention relates to a magnetic apparatus for diverse uses, primarily as a magnetic holder in the movement and handling of magnetically attractable articles, objects or bodies. More particularly, the invention relates to a hand-held magnetic holder or manipulator for the engagement, displacement and release of loads.

BACKGROUND OF THE INVENTION

The use of magnetic devices to engage, hold, lift, transport, position or carry magnetically attractable articles has been well developed and the particular aspect of this field, which is of interest here, is the class of magnetic holders which utilize permanent magnets and the mechanical displacement of a movable member or rotor to switch the device between its attractive and hence magnetic retentive mode, and its magnetically inactive mode in which an object or article can be released.

In magnetic chucks, for example, devices of this type serve to hold a workpiece by the action of the magnetic force during machining operations. Magnetic manipulators may have a handle enabling a worker to hold the device which can be applied to a magnetic body to be displaced, namely, an iron bar, plate, billet or sheet, for transport and emplacement of the latter. The manipulator can have means for connecting it to a crane, hoist, hook or lever for lifting applications.

Generally speaking, a magnetic carrier of the latter type comprises a fixed permanent magnet body which can be referred to as a stator and a movable permanent magnet body which can be referred to as a rotor and these bodies can be constructed and arranged so that, at the working face of the structure, a magnetic field can be generated in one position of the rotor or the magnetic field can be substantially annulled or canceled in another position of the rotor.

The first position will hereinafter be referred to as the effective position and the second as the ineffective position.

For the most part, the two magnet bodies are equipped with permanent magnets of high coercive force, namely ferrite magnets, and the magnetic masses of the two bodies are equal so that, in the effective position, the magnetic contributions or masses M can be additive ($M+M=2M$) whereas in the ineffective position the equal magnetic masses M cancel out ($M-M=0$). The rotor may be angularly displaced through 180° between these operative positions.

Regardless of how the parts have been constructed in the past to achieve these results, it is invariably the intent to minimize any air gap in the magnetic path, to eliminate any loss of magnetic field strength. In the past, moveover, strict adherence to very limited tolerances had to be assured in order to minimize any external field which might remain in the ineffective position of the rotor.

Notwithstanding these efforts, almost invariably in the ineffective position of the magnetic holder, a stray magnetic field or residual field could be found at the effective surface of the device. This was particularly inconvenient for hand-held units where even the least residual field could make it difficult to remove the holder from the transported article.

Furthermore, because precise adjustment was required for complete cancellation of any residual field in the inactive position of the rotor, complex efforts were required at frequent intervals for such adjustment and the fabrication of the device was complicated and made more expensive than was desirable.

OBJECTS OF THE INVENTION

It is the principal object of the present invention to provide an improved magnetic holder and manipulator which will obviate these disadvantages.

Another object of this invention is to provide a magnetic holder having a permanent magnet stator body, a permanent magnet rotor body, and means for shifting the rotor between magnetically effective and ineffective positions whereby, in the ineffective position, the magnetic field at the effective face of the device can be completely annulled without resort to precise adjustment of the device and without the need for adherence to narrow tolerances and for expensive manufacturing practices to maintain such tolerances.

Yet another object of my invention is to provide a device for the purpose described whose fabrication can be greatly simplified by comparison with earlier devices for this purpose.

SUMMARY OF THE INVENTION

These objects and others which will become apparent hereinafter are attained, in accordance with the present invention, by providing at least in the magnetic path of the rotor, an air gap which can be created by mounting the rotor with play within the stator body so that there is a magnetic field strength loss P across this gap which can correspond substantially to the difference between the magnetic field strength of the stator and the magnetic field strength of the rotor. In other words, in addition to providing the air gap, I create intentionally a disequilibration between the magnetic masses of the stator and the rotor utilizing the air gap provided by the play in mounting the rotor to compensate for this disequilibration.

More specifically, where M represents the magnetic power or mass of the stator, M1, the magnetic power or mass of the rotor and P the magnetic losses in the air gap resulting from the play between the rotor and the stator, the following relationships apply:

Ineffective rotor position: $M-(M1-P)=0$.

Effective rotor position: $M+(M1-P)=2M$.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
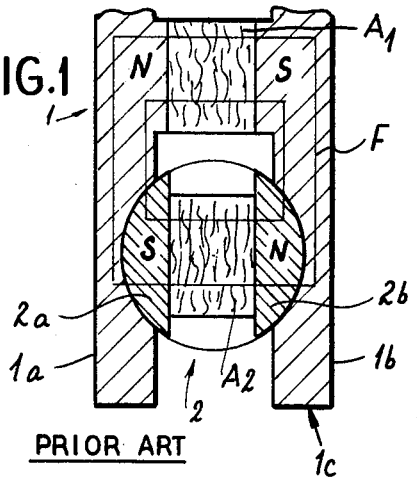
FIG. 1 is a diagrammatic cross sectional view illustrating the operation of a prior-art magnetic holder and showing the latter in its ineffective position where the magnetic field at the effective face of the device is canceled.
Figure 2:
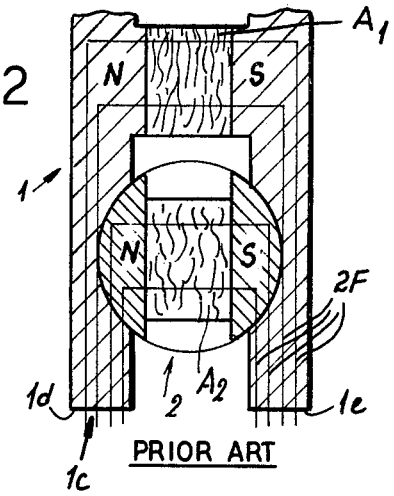
PRIOR ART FIG.2
FIG. 2 is a cross sectional view similar to FIG. 1 but showing the rotor in its other position, angularly offset from the first by 180° and corresponding to the effective position.

FIGS. 1 and 2 show the prior art arrangement which has been illustrated simply to provide an adequate background for an appreciation of the invention.

For example, in FIGS. 1 and 2, a pair of plates 1*a* and 1*b* define the stator with ferrite permanent magnet $A_1$ which has a fixed orientation so that the poles of the stator 1 are shown at N and S respectively. If there would be no rotor 2, the end face 1*c* of the body would have magnetic poles determined by the magnetic mass of member $A_1$ and an appropriate field strength.

The rotor 2 can comprise a ferrite permanent magnet $A_2$, which cooperates with pole pieces 2*a* and 2*b* forming the rotor body and can be rotated from its ineffective position shown in FIG. 1 to its effective position shown in FIG. 2.

In the ineffective position shown in FIG. 1 the lines of force F of the two permanent magnets close through the plates 1*a* and 1*b* and hence the magnetic fluxes cancel one another so at the face 1*c* no magnetic field can occur except that which may result from failure to adhere to the tight tolerances of the system or from failure of precise adjustment.

In this position, where each of the magnetic masses is designated at M, the field strength at the face 1*c* is represented by relationship $M-M=0$.

When the rotor is rotated through 180° (FIG. 2) the permanent magnets do not act counter to one another but rather act additively so that at the magnetic poles 1*d* and 1*e* of the face 1*c*, magnetic field lines 2F are generated. In this effective position $M+M=2M$ and a magnetically attractable body through which the lines 2F close can be held tightly by the unit.

Figure 3:
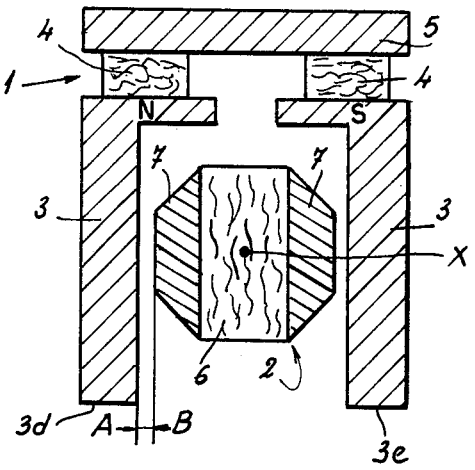
PRIOR ART FIG.3
FIG. 3 is a diagram similar to FIGS. 1 and 2 but illustrating the principle of the present invention.
Figure 6:
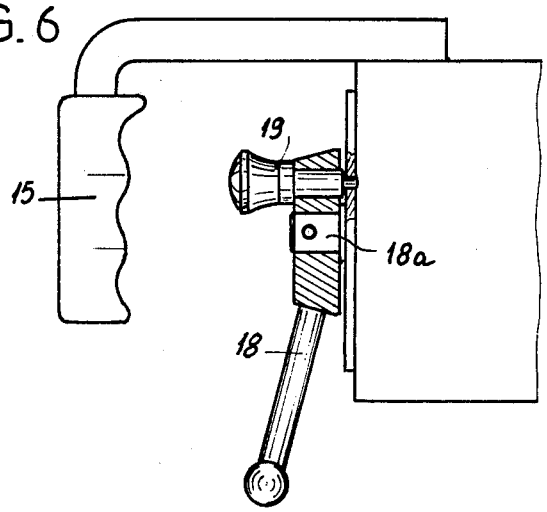
FIG. 6 is a partially elevational view of this device, partly broken away.

FIG. 3 illustrates the principle of the present invention. Here the rotor is again designated at 2 while the stator is represented at 1. The stator is constituted by a cage formed by two pole pieces or plates 3 flanking the rotor and held in a housing 9 in which the rotor is journaled.

Instead of a single magnet $A_1$, the magnetic stator mass of the device of the invention can be subdivided into two ferrite permanent magnets 4, each of which overlies one of the plates 3, the flux path being closed by a magnetically permeable plate 5.

The rotor 2 is constituted by a ferrite permanent magnet 6 and two pole pieces 7 which are juxtaposed with the plate 3 and can be rotated between two positions angularly offset through 180° as previously described. In one of these positions, the magnetic field at the pole pieces 3*d* and 3*e* is annulled while in the other position, the stator magnets 4 and the rotor magnets 6 contribute the same polarities to the pole pieces and thus provide an additive field strength. The axis of rotation is represented at X and runs perpendicular to the plane of the paper in FIGS. 3 and 5.

As is shown in FIG. 3, the inner faces of the two pole pieces 3 or plates of the stator are planar and between the pole pieces 3 and the pole pieces 7 of the rotor a mounting play A-B is provided which is sufficient to permit rotation of the rotor. This play is represented by an air gap resulting in magnetic field losses. These losses are compensated by a disequilibration intentionally provided to the magnetic masses of mangets 4 of the stator with respect to the magnet 6 of the rotor. As has been shown in FIG. 3, the magnetic mass of the magnet 6 is substantially greater (by the equivalent to the losses P) than the total of the magnetic mass of the two magnets 4 of the stator.

The effective functioning of the magnetic holder is improved because special care is not required in assembly or adjustment in that the play is fully compensated by increasing the magnetic field strength of the rotor magnet.

However, because of this play, when the magnet acts subtractively, the magnetic losses tend to dominate and can prevent residual fields from maintaining any attractive force at the ends 3*d* and 3*e* of the poles.

Figure 4:
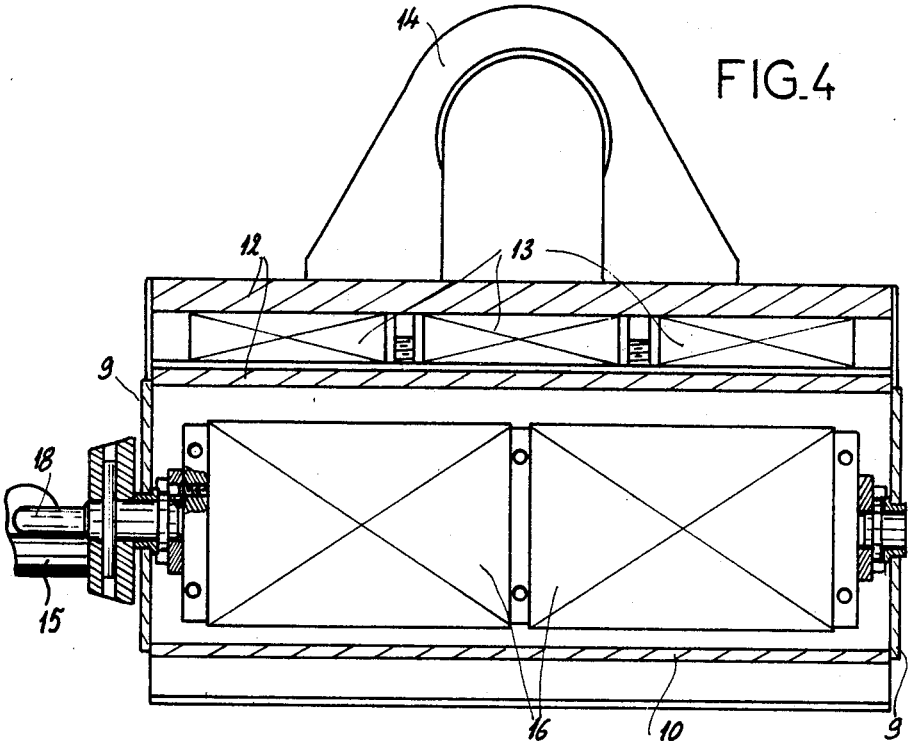
FIG. 4 is a longitudinal section through a holder embodying the invention and showing the magnetic holder of the invention in greater structural detail.
Figure 5:
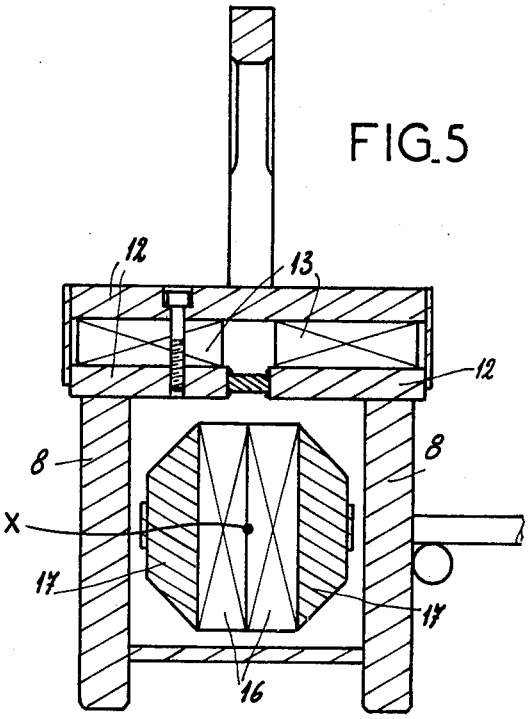
FIG. 5 is a transverse section in somewhat diagrammatic form through the device of FIG. 4.

FIGS. 4 and 5 show a practical embodiment utilizing the reference described in connection with FIG. 3 for a magnetic carrier.

The latter comprises a housing or cage defined by two ferromagnetic lateral plates 8, by two nonmagnetic cheek plates 9, by a nonmagnetic plate 10 parallel to the face to which the carried article is to be attracted, and by three ferromagnetic plates 12 of which the two lower ones are isolated from one another and receive the three magnets 13 between them. When reference is made to nonmagnetic plates here, it is intended to so designate plates through which a magnetic field may be conducted but which means are not necessarily magnetically attractive or magnetizable.

The cage is provided with an eye 14 by which the cage can be suspended from a wrench, cable, crane or other lifting device and is provided with a handle 15 which can facilitate its manipulation while it is suspended.

The cage or housing, therefore, forms a stator, the interior of which is provided with the rotor which can be rotated between the two positions previously described, i.e. the ineffective position and the effective position.

The rotor is journaled on the cheek plates 9 and carries magnet 16 and the pole plates 17. The handle wheel 18 is connected to the shaft 18*a* of the rotor to permit it to be turned, and is provided with a pin 19 which can be withdrawn from a hole in the left-hand cheek plate 9 to permit rotation and can be inserted into a hole associated with each position to lock the rotor in either of its two positions, selectively. Any other detent means can be substituted for the pin 19.

Naturally, the embodiment illustrated and described is capable of modification within the spirit and scope of the claims to modify the orientations of the magnets, substitute other magnets for the ferrite magnets which are described, etc.

I claim:

1. A magnetic holder adapted to retain a magnetically attractable article, comprising:

a stator provided with a pair of pole pieces and having first permanent magnet means defining a first magnetic mass proportional to the field strength generated by said first permanent magnet means;

a rotor having second permanent magnet means defining a second magnetic mass contributing magnetic force to said pole pieces in one angular position of said rotor and cancelling magnetic force from said first permanent magnet means in a second angular position of said rotor, said second magnetic mass being greater than said first magnetic mass; and means for mounting said rotor in said stator for angular displacement between said positions with play defining an air gap causing magnetic field losses in the contribution of said second magnetic means to the magnetic force at said pole pieces, said play being dimensioned to contribute magnetic losses corresponding substantially exactly to the excess of the magnetic mass of said second permanent magnet means over the magnetic mass of said first permanent magnet means, said first magnetic mass M, said second magnetic mass M1 and said magnetic losses P being related by the relationship:

in the first mentioned position of said rotor: $M+(M-P)=2M$, and in the second of said positions: $M-(M1-P)=0$.

2. The magnetic holder defined in claim 1 wherein said stator is formed with a housing having a nonmagnetic play disposed between said rotor and said article.

3. The magnetic holder defined in claim 2 wherein said housing is elongated and has a pair of cheek plates at opposite ends thereof, said rotor being journaled on said cheek plates.

4. The magnetic holder defined in claim 3, further comprising a shaft on said rotor extending through one of said cheek plates, and a handwheel on said shaft for rotating said rotor between said positions.

5. The magnetic holder defined in claim 4, further comprising detent means on said handwheel for selectively locking said rotor in said positions.

6. The magnetic holder defined in claim 5, further comprising a handle on said housing facilitating the manipulation thereof.

7. The magnetic holder defined in claim 6, further comprising an eye on said housing enabling same to be suspended from a crane.

8. The magnetic holder defined in claim 7 wherein said rotor comprises a pair of pole pieces flanking said second permanent magnet means.

9. The magnetic holder defined in claim 8 wherein the pole pieces of said stator are planar confronting said rotor and the play between said rotor and said stator is defined in part by said planar pole pieces to enable rotation of said rotor in said stator.

10. A magnetic holder adapted to retain a magnetically attractable article, comprising:

a stator provided with a pair of pole pieces and having first permanent magnet means defining a first magnetic mass proportional to the field strength generated by said first permanent magnet means;

a rotor having second permanent magnet means defining a second magnetic mass contributing magnetic force to said pole pieces in one angular position of said rotor and cancelling magnetic force from said first permanent magnet means in a second angular position of said rotor, said second magnetic mass being greater than said first magnetic mass; and means for mounting said rotor in said stator for angular displacement between said positions with play defining an air gap causing magnetic field losses in the contribution of said second magnetic means to the magnetic force at said pole pieces, said rotor comprising a pair of pole pieces having angular adjoining planar surfaces flanking said second permanent magnet means, the pole pieces of said stator being planar confronting said rotor and the play between said rotor and said stator is defined in part by said planar pole pieces to enable rotation of said rotor in said stator.

* * * * *